US007953355B2

(12) United States Patent
Sawai

(10) Patent No.: US 7,953,355 B2
(45) Date of Patent: May 31, 2011

(54) ENDLESS BELT MEMBER, TRANSFER UNIT INCORPORATING SAME, AND IMAGE FORMING APPARATUS INCORPORATING SAME

(75) Inventor: Yuuji Sawai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 12/508,255

(22) Filed: Jul. 23, 2009

(65) Prior Publication Data

US 2010/0021216 A1 Jan. 28, 2010

(30) Foreign Application Priority Data

Jul. 24, 2008 (JP) ..... 2008-190787

(51) Int. Cl.
*G03G 15/01* (2006.01)

(52) U.S. Cl. ..... 399/302

(58) Field of Classification Search ..... 399/302, 399/303, 312, 313, 308
See application file for complete search history.

(56) References Cited

U.S. PATENT DOCUMENTS

| | | | | |
|---|---|---|---|---|
| 6,405,002 | B2 | 6/2002 | Ogiyama et al. | |
| 6,516,179 | B1 | 2/2003 | Sawai et al. | |
| 6,611,672 | B2 | 8/2003 | Aoki et al. | |
| 6,618,565 | B2 | 9/2003 | Tamiya et al. | |
| 6,697,595 | B2 | 2/2004 | Kawagoe et al. | |
| 6,768,892 | B2 | 7/2004 | Sawai | |
| 6,785,500 | B2 | 8/2004 | Takahashi et al. | |
| 6,813,471 | B2 | 11/2004 | Sawai et al. | |
| 6,823,149 | B2 | 11/2004 | Yoshikawa et al. | |
| 6,885,842 | B2 | 4/2005 | Sawai | |
| 6,901,234 | B2 | 5/2005 | Ogiyama et al. | |
| 6,983,121 | B2 | 1/2006 | Sawai | |
| 7,003,238 | B2 | 2/2006 | Yoshida et al. | |
| 7,174,124 | B2 | 2/2007 | Ishibashi et al. | |
| 7,277,662 | B2 | 10/2007 | Sawai et al. | |
| 7,280,792 | B2 | 10/2007 | Sawai et al. | |
| 7,292,813 | B2 * | 11/2007 | Ichizawa | 399/308 |
| 7,346,287 | B2 | 3/2008 | Ogiyama et al. | |
| 7,356,296 | B2 * | 4/2008 | Ito | 399/303 |
| 7,502,583 | B2 | 3/2009 | Sawai et al. | |
| 2006/0056884 | A1 * | 3/2006 | Sawai et al. | 399/302 |
| 2007/0134029 | A1 | 6/2007 | Sawai | |

(Continued)

FOREIGN PATENT DOCUMENTS

| | | |
|---|---|---|
| JP | 11-282277 | 10/1999 |

(Continued)

*Primary Examiner* — Susan S Lee
(74) *Attorney, Agent, or Firm* — Oblon, Spivak, McClelland, Maier & Neustadt, L.L.P.

(57) ABSTRACT

A multi-layer endless belt member, which can be incorporated in a transfer unit for use in an image forming apparatus, includes a base layer and a surface layer disposed on the base layer and having a higher resistivity and has a first resistivity of a first surface thereof and a second resistivity of a second surface thereof opposite the first surface different from the first resistivity. The second resistivity of the second surface ranges from approximately 9.0 to approximately 12.5 in a common logarithm value (log [Ω/square]) when measured after 500V is applied for 10 seconds. An amount of resistivity change in the first resistivity ranges from approximately 0.5 to approximately 1.5 after application of 100V and is 0.2 or smaller after application of 500V. An amount of resistivity change in the second resistivity is 0.1 or smaller after application of 100V and 500V.

5 Claims, 5 Drawing Sheets

U.S. PATENT DOCUMENTS

| | | | |
|---|---|---|---|
| 2007/0269241 | A1 | 11/2007 | Sawai et al. |
| 2007/0280749 | A1 | 12/2007 | Sawai et al. |
| 2008/0003024 | A1 | 1/2008 | Sawai |
| 2009/0148201 | A1 | 6/2009 | Sawai |

FOREIGN PATENT DOCUMENTS

| | | |
|---|---|---|
| JP | 2006-106667 | 4/2006 |
| JP | 3972694 | 6/2007 |

* cited by examiner

ENDLESS BELT MEMBER, TRANSFER UNIT INCORPORATING SAME, AND IMAGE FORMING APPARATUS INCORPORATING SAME

CROSS-REFERENCE TO RELATED APPLICATIONS

The present invention claims priority pursuant to 35 U.S.C. §119 from Japanese Patent Application No. 2008-190787, filed on Jul. 24, 2008 in the Japan Patent Office, which is hereby incorporated by reference herein in its entirety.

BACKGROUND OF THE INVENTION

1. Field of the Invention

Exemplary embodiments of the present invention generally relate to an endless belt member, a transfer unit incorporating the endless belt member, and an image forming apparatus incorporating the endless belt member.

2. Discussion of the Related Art

Full-color image forming apparatuses for electrophotographic printing generally perform either a direct transfer operation or an indirect transfer operation. In the indirect transfer operation, which is a two-step operation, a toner image formed on an image carrier that contacts an intermediate transfer belt is transferred onto an outer circumferential surface of the intermediate transfer belt by an electric field supplied by a transfer bias unit, in an operation that is referred to as primary transfer. Then, the toner image retained by the intermediate transfer belt is transferred onto a transfer member or a recording medium conveyed along the outer circumferential surface of the intermediate transfer belt, in an operation referred to as secondary transfer. Through the primary and secondary transfers, ultimately a full-color toner image is formed on a recording medium.

For example, one related-art image forming apparatus includes a multi-layer intermediate transfer belt composed of a high-resistivity surface layer that forms an outer circumferential surface for carrying a toner image thereon and a medium-resistivity base layer that forms an inner circumferential surface of the multi-layer intermediate transfer belt to which a transfer bias that has an opposite polarity to a toner charge polarity is applied. Compared with a medium-resistivity surface layer, such a high-resistivity surface layer can provide better charge retention of the transfer bias having the opposite polarity after transfer.

If the surface layer retains only a small residual charge of the transfer bias having the opposite polarity after transfer, a toner image formed on the outer circumferential surface of the multi-layer intermediate transfer belt cannot be retained thereon electrostatically, that is, some of toner particles are scattered over the outer circumferential surface of the multi-layer intermediate transfer belt, adversely affecting the quality of the toner image. By contrast, a large residual charge of the transfer bias having the opposite polarity on the surface layer after transfer can hold the toner image formed on the outer circumferential surface of the multi-layer intermediate transfer belt with electrostatic force, thereby preventing the above-described toner scattering.

Moreover, at transfer, under a related-art constant current control, resistivity of the intermediate transfer belt is affected by such environmental factors as ambient temperature and relative humidity in the image forming apparatus. Changes in resistivity can change the size of the transfer bias having a polarity opposite the charge polarity of toner that may be applied at transfer, causing the charge potential of the intermediate transfer belt to vary as a result.

As compared with a reference resistivity under given reference temperature and humidity conditions, the resistivity of the intermediate transfer belt may decrease with high temperature and high relative humidity, which reduces the size of the transfer bias to be applied for transfer under constant-current control and consequently decreases the charge potential of the intermediate transfer belt. Further, a reduction in resistivity of the intermediate transfer belt can decrease the size of the opposite electric charge remaining on the surface layer of the intermediate transfer belt compared to the residual charge at the given reference temperature and relative humidity. Therefore, in addition to the reduced charge potential of the intermediate transfer belt, the size of the electrical charge with the opposite polarity remaining on the surface layer of the intermediate transfer belt after transfer also decreases. Due to these decreases in the sizes of the electrical charge and charge potential, the toner image formed on the outer circumferential surface of the intermediate transfer belt cannot be held with the required electrostatic force, and therefore toner scattering can easily occur.

By contrast, the resistivity of the intermediate transfer belt may increase under conditions of lower temperature and lower relative humidity, which increases the size of the transfer bias to be applied for transfer under constant-current control, and consequently increases the charge potential of the intermediate transfer belt. Further, an increase in resistivity of the intermediate transfer belt can increase the charge of the opposite polarity remaining on the surface layer of the intermediate transfer belt compared to that under the given reference temperature and relative humidity. Therefore, in addition to the increased charge potential of the intermediate transfer belt, the size of the electrical charge with the opposite polarity remaining on the surface layer of the intermediate transfer belt after transfer also increases. Due to these increases in the amounts of the electrical charge and charge potential, the toner image formed on the outer circumferential surface of the intermediate transfer belt can be held with the required electrostatic force, and therefore toner scattering can be prevented. However, it is known that, as the size of electric charge remaining on the surface layer of the intermediate transfer belt after transfer increases, residual images can appear more easily.

As described above, even when a multi-layer intermediate transfer belt having a high-resistivity surface layer and a medium-resistivity base layer is used, the occurrence of toner scattering cannot be completely eliminated. Further, residual images can be generated.

SUMMARY OF THE INVENTION

Exemplary aspects of the present invention have been made in view of the above-described circumstances.

Exemplary aspects of the present invention provide a multi-layer endless belt member that can effectively prevent an occurrence of irregularity such as toner scattering, residual image, and image with electric discharge.

Other exemplary aspects of the present invention provide a transfer unit that can incorporate the above-described multi-layer endless belt member.

Other exemplary aspects of the present invention provide an image forming apparatus that can incorporate the above-described multi-layer endless belt member.

In one exemplary embodiment, a multi-layer endless belt member includes a base layer and a surface layer for carrying a toner image thereon, disposed on the base layer and having a resistivity higher than the base layer. The multi-layer endless belt member has a first resistivity of a first surface serving as an outer surface of the multi-layer endless belt member and a second resistivity of a second surface serving as an inner surface of the multi-layer endless belt member opposite the first surface different from the first resistivity. The second resistivity of the second surface of the multi-layer endless belt member ranges from approximately 9.0 to approximately 12.5 in a common logarithm value (log [Ω/square]) when the second resistivity of the second surface is measured after 500V is applied for 10 seconds. An amount of resistivity change in the first resistivity of the first surface of the multi-layer endless belt member ranges from approximately 0.5 to approximately 1.5 in a common logarithm value (log [Ω/square]) when the first resistivity of the first surface is measured after 100V is applied and the amount of resistivity change of the first resistivity of the first surface of the multi-layer endless belt member is equal to or smaller than 0.2 in a common logarithm value (log [Ω/square]) when the first resistivity of the first surface is measured after 500V is applied, where the amount of resistivity change in the first resistivity of the first surface represents a difference between the first resistivity of the first surface measured after a given voltage is applied for 1 second and the first resistivity of the first surface measured after a given voltage is applied for 100 seconds to the first surface of the multi-layer endless belt member. An amount of resistivity change in the second resistivity of the second surface of the multi-layer endless belt member is equal to or smaller than 0.1 in a common logarithm value (log [Ω/square]) when the second resistivity of the second surface is measured after 100V is applied and 500V is applied, where the amount of resistivity change in the second resistivity of the second surface represents a difference between the second resistivity of the second surface measured after a given voltage is applied for 1 second and the second resistivity of the second surface measured after a given voltage is applied for 100 seconds to the second surface of the multi-layer endless belt member.

The surface layer having the resistivity higher than the base layer may include carbon black.

The first surface and the second surface may include layers each having at least one of an electron conductive member and an ion conductive member.

Further, in one exemplary embodiment, a transfer unit includes an intermediate transfer member onto which a toner image formed on an image carrier is temporarily transferred. The transfer unit includes the above-described multi-layer endless belt.

Further, in one exemplary embodiment, an image forming apparatus includes an image carrier to carry a latent image on a surface thereof, a developing unit to develop the latent image formed on the surface of the image carrier into a visible toner image, and the above-described transfer unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
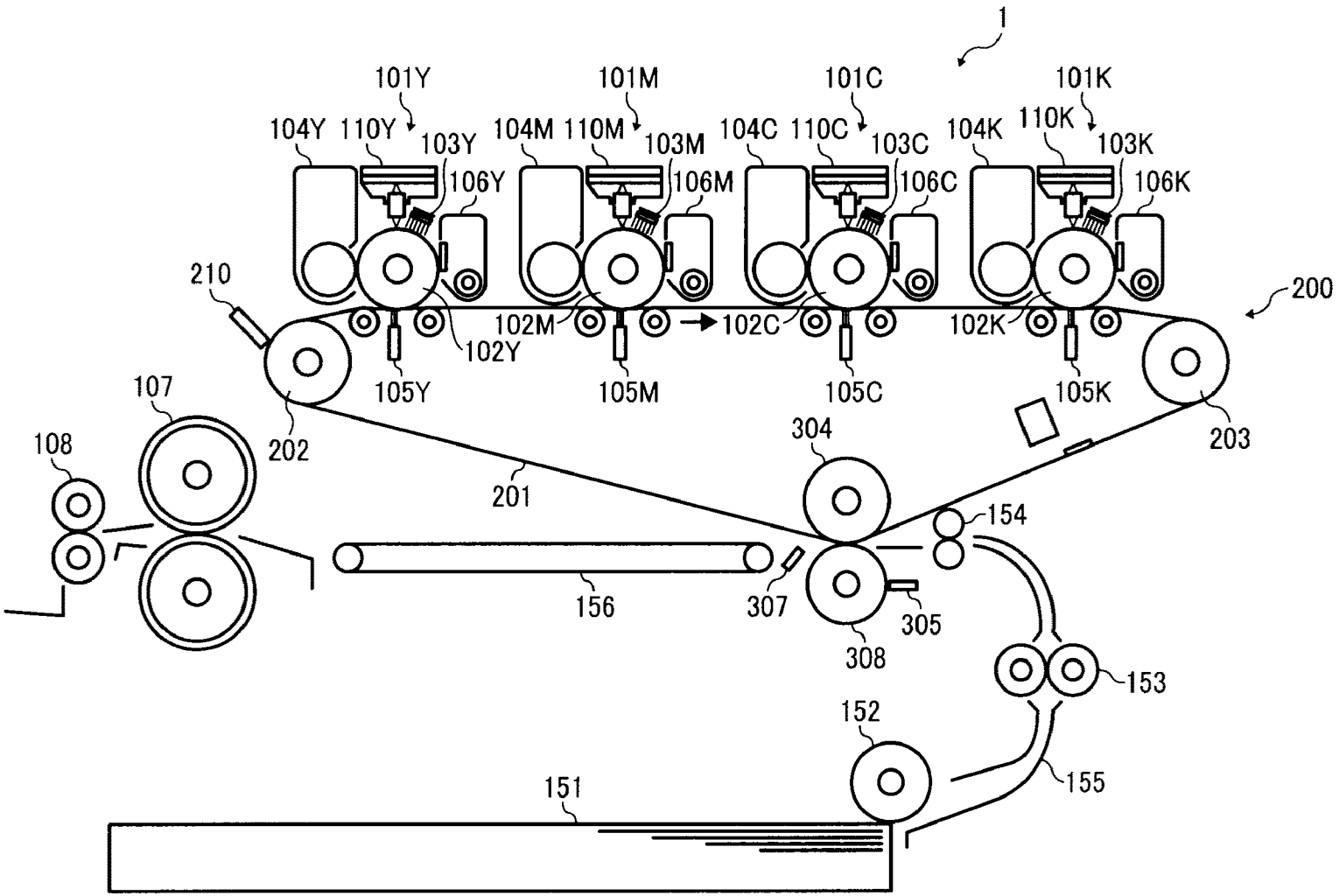
FIG. 1 is a schematic configuration of an image forming apparatus according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a drawing of a schematic configuration of an image forming apparatus 1 according to an exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting exemplary embodiment, the image forming apparatus 1 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 1 of FIG. 1 corresponds to a printer, copier, facsimile machine, etc. and employs a tandem type indirect transfer system. In other words, the image forming apparatus 1 includes multiple image forming units 101Y, 101M, 101C, and 101K that are disposed along an intermediate transfer belt 201 that serves as an intermediate transfer member. The image forming apparatus 1 includes a transfer unit 200 at a center part thereof. The transfer unit 200 includes the intermediate transfer belt 201 in a form of an endless belt member. The intermediate transfer belt 201 is wound around multiple supporting rollers, which are a first supporting roller 202, a second supporting roller 203, and a third supporting roller 304. The intermediate transfer belt 201 is rotationally conveyable in a clockwise direction in FIG. 1.

The four image forming units 101Y, 101M, 101C, and 101K for colors of yellow (Y), magenta (M), cyan (C), and black (K), respectively, are located above the intermediate transfer belt 201, particularly above a part extended between the first supporting roller 202 and the second supporting roller 203, and are arranged side by side along a conveyance direction of the intermediate transfer belt 201. The image forming units 101Y, 101M, 101C, and 101K constitute a tandem type image forming unit. The image forming units 101Y, 101M, 101C, and 101K of the tandem type image forming unit have substantially the same configuration, as shown in FIG. 2, for example.

Figure 2:
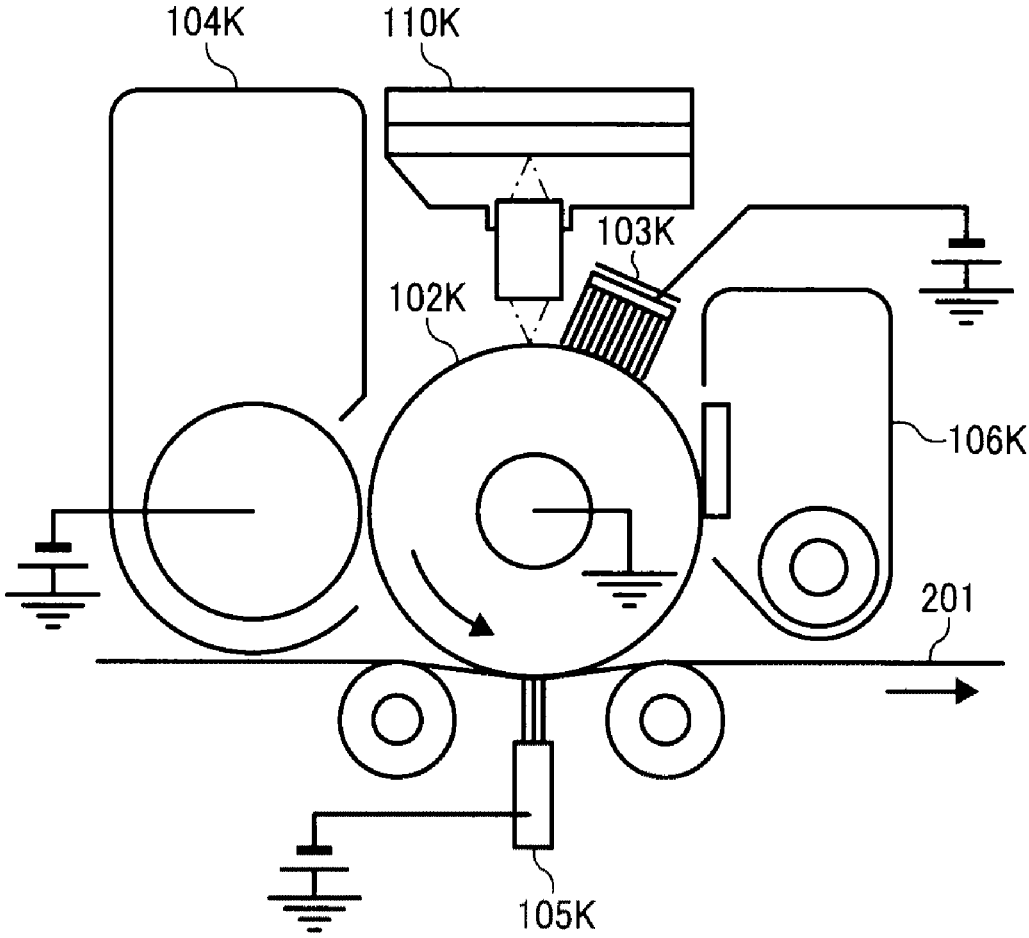
FIG. 2 is a schematic configuration of an image forming unit incorporated in the image forming apparatus of FIG. 1.

FIG. 2 illustrates a schematic configuration of the image forming unit 101K for black (K) as an example. The image forming unit 101K includes a drum-shaped photoconductor 102K (other drum-shaped photoconductors 102Y, 102M, and 102C are shown in FIG. 1), a charging unit 103K (other charging units 103Y, 103M, and 103C are shown in FIG. 1), an optical writing unit 110K (other optical writing units 110Y, 110M, and 110C are shown in FIG. 1), and a developing unit 104K (other developing units 104Y, 104M, and 104C are shown in FIG. 1). The photoconductor 102K serves as an image carrier for forming and carrying a toner image on a surface thereof. The charging unit 103K, the optical writing unit 110K, and the developing unit 104K are image forming components for forming a toner image on the surface of the photoconductor 102K.

The charging unit 103K uniformly charges the surface of the photoconductor 102K. The charging unit 103K of FIG. 2 employs a charging brush to which direct current voltage is applied. However, the charging unit 103K is not limited to a charging brush but can be a charging roller, and electrifying charger, or the like.

The optical writing unit 110K is an exposing unit of a LED writing system including a light emitting diode (LED) array and a lens array arranged in an axial direction or a main scanning direction of the photoconductor 102K in FIG. 2. The optical writing unit 110K emits the LED according to an image signal to form an electrostatic latent image on the surface of the photoconductor 102K. Other than this optical writing unit 110K, it is also possible to use an optical writing unit of a laser scanning system including a laser beam source, a light deflector such as a rotary polygon mirror, and an image scanning optical system.

The developing unit 104K includes a developing roller (or a development sleeve) that rotates while carrying a developer and agitating/conveying member that agitates the developer and conveys the developer to the developing roller. The developing unit 104K develops an electrostatic latent image formed on the surface of the photoconductor 102K with toner contained in the developer to a visible toner image. As the developer, either one-component developer consisting of only toner or two-component developer consisting of toner and magnetic carriers is used. Note that, since the image forming unit 101K shown in FIG. 2 is an example of an image forming unit for black (K), black toner is used as the toner. That is, in the image forming units 101Y, 101M, and 101C of other colors shown in FIG. 1, toners of yellow (Y), magenta (M), and cyan (C) are used, respectively.

A toner image that is formed on the surface of the photoconductor 102K through operations performed by the charging unit 103K, the optical writing unit 110K, and the developing unit 104K is transferred onto the outer surface of the intermediate transfer belt 201 in a primary transfer part or an area or part for primary transfer. A transfer brush 105K (other transfer brushes 105Y, 105M, and 105C are shown in FIG. 1) which serves as a primary transfer member is disposed at a position in the primary transfer part opposed to the photoconductor 102K across the intermediate transfer belt 201. A transfer bias is applied to the transfer brush 105K by a DC power supply. Further, a photoconductor cleaning unit 106K (other photoconductor cleaning units 106Y, 106M, and 106C are shown in FIG. 1), which removes residual toner remaining on the surface of the photoconductor 102K after image transfer, is provided on a downstream side of the primary transfer part in a direction of rotation of the photoconductor 102K.

The image forming unit 101K for black (K) has been described above as an example. The other image forming units 101Y, 101M, and 101C for yellow (Y), magenta (M), and cyan (C) are configured in the same manner. In FIG. 1, the same image forming components are denoted by the same reference numerals. Suffixes "Y", "M", "C", and "K" are attached to the respective members to distinguish the colors.

In the tandem type image forming units described above, in forming a color image, the image forming units 101Y, 101M, 101C, and 101K for yellow (Y), magenta (M), cyan (C), and black (K) form respective single toner images of yellow (Y), magenta (M), cyan (C), and black (K) on the photoconductors 102Y, 102M, 102C, and 102K, respectively. The image forming units 101Y, 101M, 101C, and 101K transfer the single toner images onto the intermediate transfer belt 201 to overlay the single toner images one on top of another to form a composite color image. In forming a black and white image, only the image forming unit 101K for black (K) forms a monochrome image and transfers the monochrome image onto the intermediate transfer belt 201.

By contrast, a secondary transfer part or an area or part for secondary transfer is provided on a side opposed to the tandem type image forming apparatus 1 across the intermediate transfer belt 201. The secondary transfer part includes a secondary transfer roller 308 that serves as an external roller, a cleaning blade 305, and a charge eliminating needle 307. The secondary transfer roller 308 is disposed to contact the third supporting roller 304, which serves as an internal roller, via the intermediate transfer belt 201 with a certain pressure. The secondary transfer roller 308 transfers a toner image on the intermediate transfer belt 201 onto a recording medium such as a paper sheet.

A sheet feeding part that includes a sheet feed cassette 151 and a sheet feed roller 152, a sheet feed path 155 having a sheet feed roller 153, and a pair of registration rollers 154 are provided on an upstream side of the secondary transfer part in a direction of conveyance of the recording medium.

Further, a conveyance unit 156, a fixing unit 107, and a sheet discharging roller 108 are provided on a downstream side of the secondary transfer part. The conveyance unit 156 conveys a recording medium having an image transferred thereon. The fixing unit 107 fixes the transferred image on the recording medium. The sheet discharging roller 108 discharges the recording medium after fixing to a sheet discharging unit.

Further, an intermediate transfer belt cleaning unit 210 is disposed on the left side of the first supporting roller 202 of the multiple supporting rollers in FIG. 1. The intermediate transfer belt cleaning unit 210 removes residual toner remaining on an outer surface or outer circumferential surface of the intermediate transfer belt 201 after image transfer.

Next, a detailed description is given of image forming performed by the image forming apparatus 1 having the above-described configuration.

When a start switch of an operation unit, not shown, is pressed, a drive motor, not shown, rotates one of the first supporting roller 202, the second supporting roller 203, and the third supporting roller 304. At the same time, the other two supporting rollers are rotated with the one supporting roller, whereby the intermediate transfer belt 201 is rotated. At the same time, the photoconductors 102Y, 102M, 102C, and 102K serving as image carriers are rotated in the image forming units 101Y, 101M, 101C, and 101K of the respective colors. Single color images of yellow, magenta, cyan, and black are formed on the photoconductors 102Y, 102M, 102C, and 102K, respectively. According to the conveyance of the intermediate transfer belt 201, these single color images are sequentially transferred onto the intermediate transfer belt 201 to be superimposed one on top of another in the primary transfer part. As a result, a composite full-color image is formed on the intermediate transfer belt 201.

Further, when the start switch is pressed, the sheet feed roller 152 is rotated and a sheet-like recording medium such as paper is fed out from the sheet feed cassette 151 and guided to the sheet feed path 155. The recording medium is further conveyed toward the pair of registration rollers 154 and stopped when it contacts the pair of registration rollers 154.

Thereafter, the pair of registration rollers 154 rotates in synchronization with movement of the composite full-color image held by the intermediate transfer belt 201. The recording medium is conveyed to a position between the intermediate transfer belt 201 and the secondary transfer roller 308 or an external roller 308 of the secondary transfer part. Then, the full-color image is transferred onto the recording medium according to transfer by the secondary transfer roller 308.

[Composite Belt]

Referring to FIGS. 3A, 3B, 3C, and 3D, cross-sectional views of schematic configurations of composite belts having different resistivities in a direction of thickness. Each composite belt corresponds to the intermediate transfer belt 201. Therefore, hereinafter the composite belt is also referred to as the intermediate transfer belt 201.

In FIGS. 3A, 3B, 3C, and 3D, each circle (○) represents an electron conductive agent (carbon black) to indicate that, where the more the conductive agents are, the smaller the resistivity of the composite belt or the intermediate transfer belt 201 is. That is, the composite belts or the intermediate transfer belts 201 of FIGS. 3A, 3B, and 3C have respective layers having resistivity higher than respective base layers.

Figure 3A:
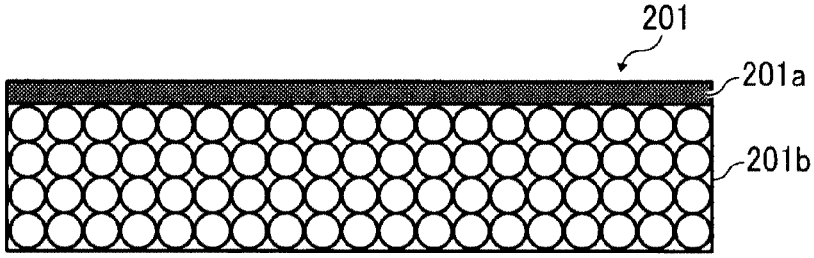
FIG. 3A is a schematic view of a composite belt having a lamination structure.

The conductive agents, not illustrated, are added to a surface layer 201*a* over a base layer 201*b* of the intermediate transfer belt 201 having a lamination structure of FIG. 3A.

Figure 3B:
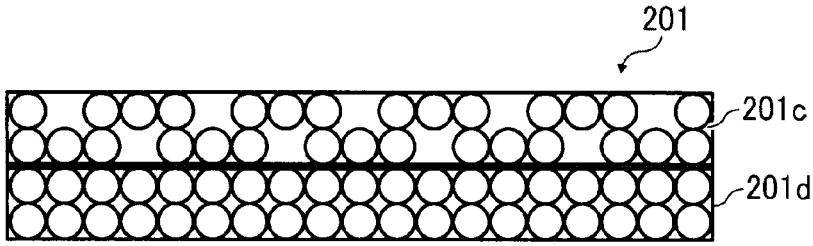
FIG. 3B is a schematic view of a composite belt having a two layer structure.

A heavy line shown in the intermediate transfer belt 201 having a two layer structure of FIG. 3B indicates a boundary between an upper layer 201*c* and a base layer 201*d* having different resistivities.

Figure 3C:
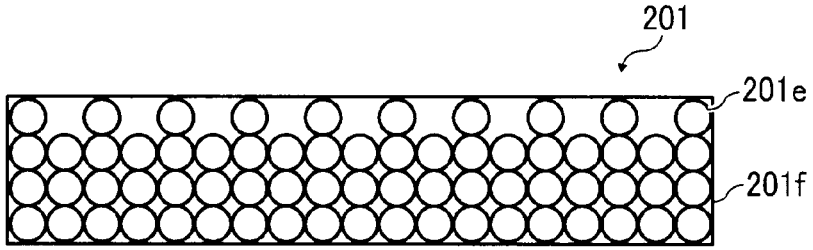
FIG. 3C is a schematic view of a composite belt having a single layer structure.

A surface side of the intermediate transfer belt 201 having a single layer structure of FIG. 3C includes a smaller number of conductive agents to form a high-resistivity layer portion 201*e* on a base layer portion 201*f*. Even though the layer of the intermediate transfer belt 201 of FIG. 3C is not separated, the intermediate transfer belt 201 has different resistivity in the layer. That is, in the intermediate transfer belt 201 of FIG. 3C, the resistivity of one surface is greater than the resistivity of the other surface. Therefore, the intermediate transfer belt 201 is regarded as a composite belt.

Figure 3D:
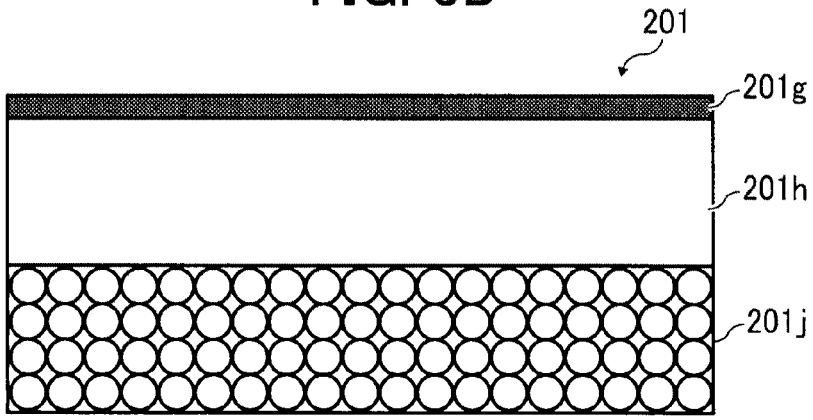
FIG. 3D is a schematic view of a composite belt having a three layer structure including an elastic layer as an intermediate layer.

The intermediate transfer belt 201 of FIG. 3D includes three layers, which are a surface layer 201*g*, an intermediate layer 201*h*, and a base layer 201*j*, and shows a structure of an elastic intermediate transfer belt that is recently employed for the composite belt.

As previously described, the intermediate transfer belt 201 of FIG. 3A has two layers having the surface layer 201*a* and the base layer 201*b*. However, the intermediate transfer belt 201 of FIG. 3A can have three layers by including an intermediate layer formed by an elastic material between the surface layer 201*a* and the base layer 201*b*, which is similar to the intermediate transfer belt 201 of FIG. 3D. Also, a primer layer can be added to increase adhesion ability between layers, if needed.

[Manufacturing Intermediate Transfer Belt]

The method for preparing the intermediate transfer belt 201 is not particularly limited, and any known methods such as dip coating methods, centrifugal molding methods, extrusion molding methods, inflation methods, coating methods, and spraying methods, with inner mold or outer mold, can be used.

The surface layer, which is a thin layer of the composite belt, can be prepared by any suitable known methods. Specific examples of typical methods are, but not limited to, spray coating methods, dip coating methods, and flow coating methods.

A two-layer belt member is manufactured by using a centrifugal molding method, in which an outer layer of the two-layer belt member is formed, dried, and solidified, then an inner layer (or the base layer) is formed, dried, and solidified. A single-single layer belt member is also manufactured by using the centrifugal molding method, in which the single layer is half dried so that carbon black is inserted into the layer, fixed in the layer, and then made movable. For example, a belt member including polyimide is half dried and carbon black is inserted into the layer to be solidified therein. After the solidification, moisten the surface with a solvent to swell and dissolve part of the layer to make carbon black movable, and the belt member is dried again. By transferring the conductive agent into the surface layer, the amount of carbon black on the surface layer can be reduced in the drying process so as to cause the surface layer to have high resistivity.

[Materials for Basic Layer]

Suitable materials for use in preparing a base layer of the intermediate transfer belt 201 include polyimide resins, polyamide-imide resins, polycarbonate resins, polyphenylene sulfide resins, polyurethane resins, polybutylene terephthalate resins, polyvinylidene fluoride resins, polysulfone resins, polyether sulfone resins, polymethyl pentene resins, and combinations thereof. In view of the strength, polyimide resins, and polyamide-imide resins are preferably used. It is preferable to add a conductive carbon black to the intermediate transfer belt 201 to control the resistivity thereof.

[Elastic Materials for Intermediate Layer]

Suitable elastic materials for use in preparing an intermediate layer of the intermediate transfer belt 201 include a single compound or two or more compounds selected from a set including chloroprene rubbers, urethane rubbers, isoprene rubbers, butyl rubbers, epichlorohydrin type rubbers, fluorine type rubbers, silicone rubbers, acrylic rubbers, EPDM, SBR, NBR, acrylonitrile-butadiene-styrene rubbers, and the like.

It is preferable to add a conductive agent such as ion conductive agent, carbon black, or hybrid agent including both ion conductive agent and carbon black to the intermediate transfer belt 201 to control the resistivity thereof. The conductive agent can substantially be manufactured in a same method as the base layer. For example, the conductive agent is preferably applied on the base layer in a spiral shape, which is a same method as the base layer.

A material suitable for the surface layer of the intermediate transfer belt 201 is not limited to a specific material but is demanded to be a material to reduce an adhesion force of toner to the outer circumferential surface of the intermediate transfer belt 201 and to increase secondary transferability.

Suitable examples of materials of the surface layer of the intermediate transfer belt 201 are, but not limited to, resin materials such as polyurethane, polyester, polyamide, etc. A coat layer including these resin materials can be obtained as a resin coat film by a curing agent such as isocyanato, melamine, silane coupling agent, and carbodiimide. Further, by filling a mold releasing filler, such as polytetrafluoroethylene (PTFE), silica, molybdenum disulfide, and carbon black, the coat layer can increase mold releasing performance of the surface thereof to enhance the cleaning performance and prevent accumulation of toner and discharge product material. Further, the coat layer can include conductive fillers (conductive agents), such as conductive carbon black, tin oxide, zinc oxide to control the resistivity. Further, the coat layer can include surface active agents, such as fluorine-containing surface active agent, silicone-containing surface active agent, nonion-containing surface active agent to uniformly mixing and dispersing these fillers.

One or more polyurethane resin, polyester resin, epoxy resins, etc. can be used. Further, lubrication must be high by reducing the surface energy. Therefore, one or more powders or particles of fluorine resin, fluorine compound, carbon fluoride, titanium dioxide, and silicon carbide can be dispersed in the layer; or the same kinds of the above material whose particle diameter is different can be dispersed in the layer. In addition, similar to fluorine containing rubber materials, the surface energy can be reduced by forming a fluorine-rich layer on the outer circumferential surface of the intermediate transfer belt 201 by applying heat treatment. Carbon black can be used for resistivity controlling.

Next, an example of the centrifugal molding method for preparing the intermediate transfer belt 201 using a polyimide resin will be explained.

Polyimide resins are typically prepared by subjecting an aromatic polycarboxylic anhydride (or a derivative thereof) and an aromatic diamine to a condensation reaction. Because of having a rigid main chain, such polyimide resins are insoluble in solvents and are not melted even when heated. Therefore, at first, a polyamic acid (i.e., a polyamide acid or an aromatic polyimide precursor), which can be dissolved in an organic solvent, is prepared by reacting an anhydride with an aromatic diamine. After the polyamic acid (or the like) is molded by any known methods, the molded polyamic acid is heated or subjected to a chemical treatment to perform dehydration and ring formation (i.e., imidization). Thus, a molded polyimide resin is prepared.

Specific examples of the aromatic polycarboxylic anhydrides include ethylenetetracarboxylic dianhydride, cyclopentanetetracarboxylic dianhydride, pyromellitic anhydride, 3,3',4,4'-benzophenonetetracarboxylic dianhydride, 3,3',4,4'-biphenyltetracarboxylic dianhydride, etc., but are not limited thereto. These compounds can be used alone or in combination.

Specific examples of the aromatic diamines include, but are not limited to, m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, etc., but are not limited thereto. These compounds can be used alone or in combination.

By polymerizing an aromatic polycarboxylic anhydride with a diamine, which are mixed in a molar ratio of about 1:1, in a polar organic solvent, a polyimide precursor (i.e., a polyamic acid) can be prepared.

Suitable solvents for use as the polar organic solvent includes any known polar organic solvents, which can dissolved a polyamic acid, and N,N-dimethylformamide and N-methyl-2-pyrrolidone are preferably used.

Although it is easy to synthesize a polyamic acid, various polyimide varnishes in which a polyamic acid is dissolved in an organic solvent are marketed.

Specific examples of such varnishes include TORAYNEECE (from Toray Industries Inc.), U-VARNISH (from Ube industries, Ltd.), RIKACOAT (from New Japan Chemical Co., Ltd.), OPTOMER (from Japan Synthetic Rubber Co., Ltd.), SE812 (from Nissan Chemical Industries, Ltd.), CRC8000 (from Sumitomo Bakelite Co., Ltd.), etc.

Specific examples of the resistivity controlling agents for use in the polyimide resins include powders of conductive resistivity controlling agents such as carbon black, graphite, metals (e.g., copper, tin, aluminum, and indium), metal oxides (e.g., tin oxide, zinc oxide, titanium oxide, indium oxide, antimony oxide, bismuth oxide, tin oxide doped with antimony, and indium oxide doped with tin), etc.

In addition, ion-conducting resistivity controlling agents can also be used. Specific examples thereof include tetraalkyl ammonium salts, trialkylbenzyl ammonium salts, alkylsulfonic acid salts, alkylbenzenesulfonic acid salts, alkylsulfates, esters of glycerin and a fatty acid, esters of sorbitan and a fatty acid, polyoxyethylenealkylamine, esters of polyoxyethylenealiphatic alcohols, alkylbetaine, lithium perchlorate, etc., but are not limited thereto.

Among these resistivity controlling agents, carbon black is preferably used for polyimide resins.

The thus prepared polyamic acid is heated at a temperature of from 300 degrees Celsius to 350 degrees Celsius to be converted to a polyimide resin.

Next, the melt molding method for preparing the intermediate transfer belt 201 will be explained.

When continuous melt extrusion molding methods are used for preparing seamless belts, thermoplastic resins are preferably used. Specific examples of such thermoplastic resins include polyethylene, polypropylene, polystyrene, polybutylene terephthalate (PBT), polyethylene terephthalate (PET), polycarbonate (PC), ethylene-tetrafluoroethylene copolymers (ETFE), polyvinylidene fluoride (PVdF), etc.

Melt molding methods are broadly classified into continuous melt extrusion molding methods, injection molding methods, blow molding methods, inflation molding methods, etc. Among these methods, continuous melt extrusion molding methods are preferably used for preparing a seamless belt.

Carbon black is typically used as an electron conductive agent for the intermediate transfer belt 201. The dispersion state of a carbon black in a belt formed by a kneading extrusion method, in which a carbon black is dispersed by kneading and extruding with high pressure, is typically inferior to that in a belt formed by a method such as a centrifugal molding method in which a carbon black is dispersed by using a liquid material such as a highly dispersive conductive agent. Therefore, the electrostatic characteristics of the variation of resistivity of a belt formed by a kneading extrusion method may tend to be inferior to that of a belt formed by the above-described method using a liquid material.

[Example of Manufacturing Intermediate Transfer Belt]

In an exemplary embodiment of the present invention, polymerization of 3,3',4,4'-biphenyl tetracarboxylic acid dianhydride as the aromatic polyhydric carboxylic anhydride, p-phenylenediamine as the aromatic diamine, and N-methyl-2-pyrrolidone (NMP) as the organic polar solvent was performed to obtain a polyamic acid solution. Acetylene black was added to the polyamic acid solution, to the amount of 17% to the solid content density thereof. The mixture is agitated with Aquamizer manufactured by HOSOKAWA MICRON CORPORATION. Thus, polyamic acid having 18% of solid content as precursor of polyimide resin was prepared.

[Base Layer]

The polyamic acid obtained as above was molded into a ring or loop through a centrifugal molding method while a metal cylindrical mold having a diameter of 319 mm was rotated at a speed of 100 rpm, and polyamic acid having a solid content of 19% was uniformly applied to an inner surface of the cylindrical mold by a dispenser. Next, the cylindrical mold was rotated at a speed of 1000 rpm for 5 minutes to level the polyamic acid. Then, the rotation speed was reduced to 300 rpm, and the cylindrical mold was gradually heated to 130 degrees Celsius. The polyamic acid was dried for 40 minutes and was solidified. After the solidification, the cylindrical mold was stopped to rotate and heated to 350 degrees Celsius, to cause imide ring-closing. Thus, imidization was completed and polyimide coating was obtained.

Next, the cylindrical mold was cooled to room temperature and the polyimide coating was removed therefrom. Both edges of the polyamic coating were cut off so that the polyamic coating had a width of 330 mm. From the above, a seamless intermediate transfer belt 201 having a layer thickness of 80 μm was produced. The resistivity of the intermediate transfer belt 201 was adjusted by an electron conductive additive amount (carbon black).

In the above-described example, the base layer was manufactured in a centrifugal molding method. However, embodiments of the present invention are not limited to the centrifugal molding method. For example, a spiral coating can be applied to the outer circumferential surface of the inner mold in rotation. This method of manufacturing the intermediate transfer belt 201 having laminated layers is preferable because an elastic layer and a surface layer can be formed right after the base layer is formed.

[Surface Layer]

Next, the seamless intermediate transfer belt 201 that serves as a base layer having a layer thickness of 80 μm covered the cylindrical mold having a diameter of 319 mm. Both edges in a longitudinal direction of the cylindrical mold are sealed up with tape.

Polyurethane pre-polymer (100 parts by weight), curing agent; isocyanate (3 parts by weight), carbon black (10 parts by weight), dispersing agent (4 parts by weight), and MEK (500 parts by weight) were uniformly dispersed for a surface layer. The cylindrical mold with polyimide resin formed thereon was dipped, pulled out at 30 mm/sec, and dried naturally. The above process was repeated to form a surface layer of urethane polymer having a thickness of 5 μm where the carbon black was uniformly dispersed. After dried in room temperature, the cylindrical mold was cross-linked at 130 degrees Celsius for 2 hours to obtain the intermediate transfer belt 201 having a two-layer structure with a resin layer having a thickness of 80 μm and a surface layer having a thickness of 5 μm. The thickness of the surface layer was controlled by the number of repetition of the process and the solid content concentration of polymer. Further, the surface resistivity was varied by changing the amount of conductive agent.

[Surface Resistivity]

The surface layer resistivity can be adjusted with the resistivity, additive amount, and particle diameter (secondary particle) of carbon black. When the particle diameter of carbon black is large, intervals in particles can vary. This can easily form a conductive path of electric current, and therefore the resistivity of the surface layer may become smaller and the pressure capacity may decrease, which can increase the voltage dependency. When the performance of fluid dispersion of carbon becomes high, as the intervals in particles of carbon becomes more even, the resistivity of the surface layer may become greater and the pressure capacity may increase, which can decrease the voltage dependency.

As described above, when the dispersion performance of carbon becomes high, the resistivity of the surface layer may become great. Therefore, to adjust the resistivity, the resistivity and additive amount of carbon need to be optimized. However, an increase in the additive amount of carbon can simply cause the surface layer to become hard and fragile. To avoid such a structure, an optimization design that can give a great load to the evaluation is needed. Further, to increase dispersion of carbon is to increasing a time for dispersion and a time for mixing and kneading, which can generally cause an increase in cost. Therefore, a ring formation that can provide high quality and effective cost performance is required.

[Example of Manufacturing Elastic Belt]

In an exemplary embodiment of the present invention, as a base layer, polymerization of 3,3',4,4'-biphenyl tetracarboxylic acid dianhydride as the aromatic polyhydric carboxylic anhydride, p-phenylenediamine as the aromatic diamine, and N-methyl-2-pyrrolidone (NMP) as the organic polar solvent was performed to obtain a polyamic acid solution. Acetylene black was added to the polyamic acid solution, to the amount of 17% to the solid content density thereof. The mixture is agitated with Aquamizer manufactured by HOSOKAWA MICRON CORPORATION. Thus, polyamic acid having 18% of solid content as precursor of polyimide resin was prepared.

The polyamic acid obtained as above was molded through a spiral molding method. While a metal cylindrical mold having a diameter of 319 mm was rotated at a speed of 30 rpm, polyamic acid having a solid content of 19% was uniformly applied to an outer surface of the cylindrical mold in an axial direction thereof by a dispenser having a width of 5 mm at a speed of 5 mm/cycle. Next, the cylindrical mold was rotated at a speed of 1000 rpm for 5 minutes to level the polyamic acid.

Then, the rotation speed was reduced to 300 rpm, and the cylindrical mold was gradually heated to 130 degrees Celsius. The polyamic acid was dried for 40 minutes and was solidified. After the solidification, the cylindrical mold was stopped to rotate and heated to 350 degrees Celsius, to cause imide ring-closing. Thus, imidization was completed and polyimide coating having a layer thickness of 80 μm was obtained. The resistivity of the polyimide coating was adjusted by an electron conductive additive amount (carbon black or CB).

A material for manufacturing an elastic layer was obtained by kneading in a mixed kneading method, which contained 100 parts of chloroprene rubbers (CR: DENKA CHLOROPRENE A-30 manufactured by Denki Kagaku Kogyo K.K.), 1.5 parts of vulcanizing agent (SANCELER 22C manufactured by Sanshin Chemical Industry Co., Ltd.), and 2 parts of carbon black (KETJEN BLACK manufactured by Ketjen Black International Co.) and by dissolving in methyl ethyl ketone (MEK).

The elastic layer was molded on the surface of the base layer formed on the outer circumferential surface of the cylindrical mold through a spiral molding method, which is same as the base layer. While a metal cylindrical mold having a diameter of 319 mm was rotated at a speed of 40 rpm, the elastic material was uniformly applied to an outer surface of the cylindrical mold in an axial direction thereof by a dispenser having a width of 5 mm at a speed of 5 mm/cycle. Next, the cylindrical mold was rotated at a speed of 1000 rpm for 5 minutes to level the liquid.

Then, the rotation speed was reduced to 300 rpm, and the cylindrical mold was gradually heated to 150 degrees Celsius. The polyamic acid was dried for 50 minutes and was solidified. After the solidification, the cylindrical mold obtained an elastic layer having a thickness of 250 μm. Thus, the surface layer was formed onto the elastic belt.

Polyurethane pre-polymer (100 parts by weight), curing agent; isocyanate (3 parts by weight), carbon black (10 parts by weight), dispersing agent (4 parts by weight), and MEK (500 parts by weight) were uniformly dispersed for a surface layer. The cylindrical mold with elastic layer formed thereon was dipped, pulled out at 30 mm/sec, and dried naturally. The above process was repeated to form a surface layer of urethane polymer having a thickness of 5 μm where the carbon black was uniformly dispersed. After dried in room temperature, the cylindrical mold was cross-linked at 130 degrees Celsius for 2 hours to obtain an elastic intermediate transfer belt having a three-layer structure with a resin layer having a thickness of 80 μm, a rubber layer having a thickness of 250 μm, and a surface layer having a thickness of 5 μm.

The thickness of the surface layer was controlled by the number of repetition of the process and the solid content concentration of polymer. Further, the surface resistivity was varied by changing the amount of conductive agents.

The resistivity of an elastic layer was controlled by a carbon black alone, a tetra alkyl ammonium salt as ion conductive agent alone, or a hybrid agent including both a carbon black and a tetra alkyl ammonium salt.

A two-layer belt such as the intermediate transfer belt 201 shown in FIG. 3B can be molded through a centrifugal molding method as described below. The outer layer (e.g., the surface layer) and the inner layer (e.g., the base layer) include the same material with different amounts of carbon black contained therein. That is, the outer layer has a smaller amount of carbon black than the inner layer so as to vary the resistivity. While a metal cylindrical mold having a diameter of 319 mm was rotated at a speed of 100 rpm, polyamic acid having a solid content of 19% was uniformly applied to an inner surface of the cylindrical mold by a dispenser. Next, the cylindrical mold was rotated at a speed of 1000 rpm for 5 minutes to level the polyamic acid.

Then, the rotation speed was reduced to 300 rpm, and the cylindrical mold was gradually heated to 130 degrees Celsius. The polyamic acid was dried for 40 minutes and was solidified then cooled to room temperature. After that, while the metal cylindrical mold with the outer layer formed thereon was rotated at a speed of 100 rpm, polyamic acid having a solid content of 19% was uniformly applied to an inner layer of the cylindrical mold by a dispenser. Next, the cylindrical mold was rotated at a speed of 1000 rpm for 5 minutes to level the polyamic acid. Then, the rotation speed was reduced to 300 rpm, and the cylindrical mold was gradually heated up to 130 degrees Celsius. The polyamic acid was dried for 40 minutes and was solidified.

After the solidification, the cylindrical mold was stopped and heated to 350 degrees Celsius to cause imide ring-closing. Thus, imidization was completed and polyimide coating was obtained. Next, the cylindrical mold was cooled to room temperature and the polyimide coating was removed therefrom. Both edges of the polyamic coating were cut off so that the polyamic coating had a width of 330 mm. From the above, a seamless intermediate transfer belt (i.e., intermediate transfer belt 201) having a layer thickness of 80 μm of the inner and outer layers was produced.

Further, a single-layer belt such as the intermediate transfer belt 201 shown in FIG. 3C is molded on the surface of the base layer formed on the outer circumferential surface of the cylindrical mold through a spiral molding method. While a metal cylindrical mold having a diameter of 319 mm was rotated at a speed of 30 rpm, polyamic acid having a solid content of 19% was uniformly applied to an outer surface of the cylindrical mold in an axial direction thereof by a dispenser having a width of 5 mm at a speed of 5 mm per rotation.

Next, the cylindrical mold was rotated at a speed of 1000 rpm for 5 minutes to level the polyamic acid. Then, the rotation speed of the cylindrical mold was reduced to 300 rpm, and the cylindrical mold was gradually heated to 130 degrees Celsius. The polyamic acid was dried for 40 minutes and was solidified. Then, while the metal cylindrical mold with the outer layer formed thereon was rotated at a speed of 100 rpm, a constant amount of N-methyl-2-pyrrolidone (NMP) as the organic polar solvent is sprayed over the outer layer of the metal cylindrical mold.

[Tests]

Next, descriptions are given of tests conducted by the inventor to evaluate the belt member that can reduce occurrence of toner scattering, residual image, image with electric discharge, and so forth, and produce an image having good quality. Table 1 shows results of characteristic comparative table, image evaluation, and comprehensive evaluation of Examples 1 to 3 and Comparative Examples 1 to 6 used for the tests.

TABLE 1

| | EX 1 | EX 2 | EX 3 | CE 1 | CE 2 | CE 3 | CE 4 | CE 5 | CE 6 |
|---|---|---|---|---|---|---|---|---|---|
| SL Material | UR | UR | UR | UR | UR | UR | UR | UR | UR |
| SL Thickness (μm) | 2.1 | 2.6 | 3.5 | 2.2 | 2.2 | 2.5 | 2.5 | 1.2 | 5 |
| SL Conductive Agent | CB | CB | CB | CB | CB | Ion and CB | Ion | Non | CB |
| SL Material Resistivity (log [Ω · cm]) | 11.7 | 12.5 | 12.5 | 10.7 | 11.3 | 11.7 | 12.8 | 14 or greater | 13 |
| IL Material | CR | CR | CR | CR | CR | CR | CR | CR | CR |
| IL Thickness (μm) | 250 | 250 | 250 | 250 | 250 | 250 | 250 | 250 | 250 |
| IL Conductive Agent | Ion and CB | Ion and CB | Ion and CB | Ion and CB | Ion | Ion | Ion | Ion | Ion |
| BL Material | Polyimide | Polyimide | Polyimide | Polyimide | Polyimide | Polyimide | Polyimide | Polyimide | Polyimide |
| BL Thickness (μm) | 80 | 80 | 80 | 80 | 80 | 80 | 80 | 80 | 80 |
| BL Conductive Agent | CB | CB | CB | CB | CB | CB | CB | CB | CB |
| Δpsf100 (log [Ω/square]) | 0.56 | 1.03 | 1.45 | 0.05 | 0.45 | 0.65 | 1.2 | 1.85 | 1.56 |
| Δpsf500 (log [Ω/square]) | 0.1 | 0.1 | 0.15 | 0.05 | 0.1 | 0.23 | 0.75 | 0.7 | 0.1 |
| Δpsb100 (log [Ω/square]) | 0.1 or smaller | 0.1 or smaller | 0.1 or smaller | 0.1 or smaller | 0.1 or smaller | 0.1 or smaller | 0.1 or smaller | 0.1 or smaller | 0.1 or smaller |
| Δpsb500 (log [Ω/square]) | 0.1 or smaller | 0.1 or smaller | 0.1 or smaller | 0.1 or smaller | 0.1 or smaller | 0.1 or smaller | 0.1 or smaller | 0.1 or smaller | 0.1 or smaller |
| Inner Surface Resistivity (log [Ω/square]) | 9.04 | 10.55 | 12.45 | 8.98 | 11.13 | 11.53 | 11.75 | 13.15 | 12.5 |
| Level of Toner Scattering | 4.5 | 4.5 | 4.5 | 3 | 3.5 | 4.5 | 4.5 | 5 | 5 |
| Residual Image | No | No | No | No | No | Yes | Yes | Yes | Yes |
| Image with Electrical Discharge | No | No | No | No | No | No | No | Yes | No |
| Comprehensive Evaluation | Good | Good | Good | Poor | Acc'ble | Acc'ble | Poor | Poor | Acc'ble |

In Table 1, "EX" represents "Example", "CE" represents "Comparative Example", "SL" represents "surface layer", "IL" represents "intermediate layer", "BL" represents "base layer", "UR" represents "urethane rubber", "CB" represents "carbon black", and "CR" represents "chloroprene rubber". Further, "Acc'ble" represents "acceptable".

Each belt member used for Examples 1 to 3 and Comparative Examples 1 to 6 was an elastic belt having a base layer that was formed by a material including polyimide and had a thickness of 80 μm, an intermediate layer that was formed by a material including chloroprene rubber and had a thickness of 250 μm, and a surface layer that was formed by a material including urethane rubber and had different thickness according to each of Examples 1 to 3 and Comparative Examples 1 to 6. The belt members are manufactured based on the above-described methods and conditions for manufacturing the composite or intermediate transfer belt. The thickness of the surface layer was measured by photographing a cross sectional view thereof by an electronic microscope.

Further, the belt members used in Examples 1 to 3 and Comparative Examples 1 to 6 have different types of conductive agents, additive amounts of conductive agent, and thickness of the surface layer so that the surface resistivity of surface layer of each belt member can be different from other belt members.

Table 1 shows the amounts of resistivity changes of outer surface $\Delta\rho s_{f100}$ and $\Delta\rho s_{f500}$ and the amounts of resistivity changes of inner surface $\Delta\rho s_{b100}$ and $\Delta\rho s_{b500}$. That is, "$\Delta\rho s_{f100}$" represents an amount of resistivity change of the outer surface (a surface on which an image is formed) of an endless belt member, which corresponds to a difference between a value of an outer surface resistivity measured after a given voltage is applied for 1 second to the outer surface and a value of an outer surface resistivity measured after a given voltage is applied for 10 seconds to the outer surface when the voltage of 100V is applied. "$\Delta\rho s_{f500}$" represents an amount of resistivity change of the outer surface of an endless belt member, which corresponds to a difference between a value of an outer surface resistivity measured after a given voltage is applied for 1 second to the outer surface and a value of an outer surface resistivity measured after a given voltage is applied for 10 second to the outer surface when the voltage of 500V is applied. "$\Delta\rho s_{b100}$" represents an amount of resistivity change of the inner surface (a surface opposite the surface on which an image is formed) of an endless belt member, which corresponds to a difference between a value of an inner surface resistivity measured after a given voltage is applied for 1 second to the inner surface and a value of an inner surface resistivity measured after a given voltage is applied for 10 second to the inner surface when the voltage of 100V is applied. "$\Delta\rho s_{b500}$" represents an amount of resistivity change of the inner surface of an endless belt member, which corresponds to a difference between a value of an inner surface resistivity measured after a given voltage is applied for 1 second to the inner surface and a value of an inner surface resistivity measured after a given voltage is applied for 10 second to the inner surface when the voltage of 500V is applied.

Following descriptions are given of how to measure the parameters shown in Table 1.

[Volume Resistivity Measurement Method/Condition]

The inventor of the present invention performed the measurement method of volume resistivity ($\rho v$) of a belt member in an exemplary embodiment with a high resistivity measuring instrument, HIRESTA-UP from MITSUBISHI CHEMICAL CORPORATION. The measurement conditions are as follows;

Resistivity measuring instrument: HIRESTA-UP (manufactured by Mitsubishi Chemical Corp.);

Probe: URS probe;

Object Supporting Member: REGI TABLE, with conductive rubber having a thickness of 1 mm;

Measurement Voltage: 100V;

Measurement Time: 10 second point; and

Pressure Force: 2 kgf.

[Surface Resistivity Measurement Method/Condition]

The inventor of the present invention performed the measurement method of surface resistivity ($\rho s$) of a belt member according to an exemplary embodiment with a high resistivity measuring instrument, HIRESTA-UP from MITSUBISHI CHEMICAL CORPORATION. The measurement conditions are as follows;

Resistivity measuring instrument: HIRESTA-UP (manufactured by MITSUBISHI CHEMICAL CORPORATION);

Probe: URS probe;

Object Supporting Member: REGI TABLE, insulated;

Measurement Voltage: 500V;

Measurement Time: 10 second point; and

Pressure Force: 2 kgf.

In the first exemplary embodiment, volume resistivity and surface resistivity are described in common logarithm values as follows:

Volume Resistivity: log (Ω·cm); and

Surface Resistivity: log (Ω/square).

[Difference between Amounts of Resistivity Changes of Surfaces]

Figure 4:
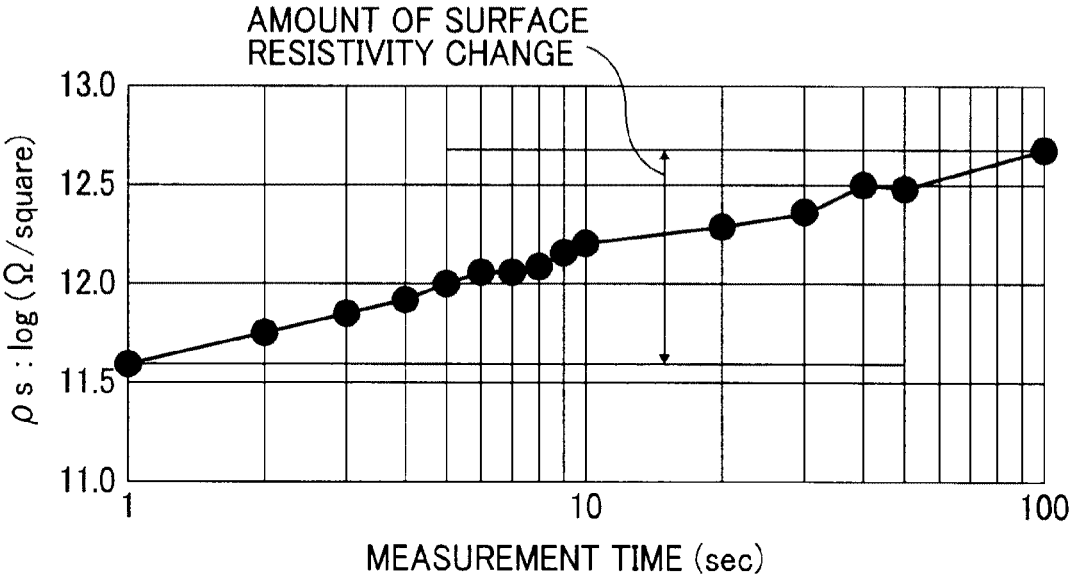
FIG. 4 is a graph showing an amount of surface resistivity change of a belt.

As shown in FIG. 4, a difference between amounts of resistivity changes of the surfaces of the intermediate transfer belt 201 is defined to be a difference between a value of the surface resistivity measured after a given voltage is applied for 1 second and a value of the surface resistivity measured after a given voltage is applied for 100 seconds. The difference can be expressed in the following Expression 1:

Amounts of Surface Resistivity Changes=Value measured after a given voltage is applied for 100 seconds−Value measured after a given voltage is applied for 1 second.

However, when any value of a surface resistivity during the measurement time between 1 second and 100 seconds becomes higher than a value of the surface resistivity measured after a given voltage is applied for 100 seconds, the higher value of the surface resistivity may be replaced to be the maximum surface resistivity value, and a difference between the maximum surface resistivity value and the value measured after a given voltage is applied for 1 second may become an updated difference between amounts of resistivity changes of surfaces of the intermediate transfer belt 201.

[Voltage Dependency of Surface Resistivity]

A voltage dependency of surface resistivity, which is a characteristic that a resistivity increases as an applied voltage increases, is defined as a value between a value of the surface resistivity measured when a volume of 500V is applied and a value of the surface resistivity measured when a volume of 100V is applied.

Further, the results of image evaluation (toner scattering, residual image, and image having electric discharge) and the comprehensive evaluation shown in Table 1 were obtained by attaching a belt member of Examples 1 to 3 and Comparative Examples 1 to 6 shown in Table 1 as the intermediate transfer belt 201 to the transfer unit 200 incorporated in the image forming apparatus 1 shown in FIG. 1. The parameters were evaluated with an image formed on the 10th paper sheet after continuously copying 10 paper sheets under an environmental condition at a temperature of 10 degrees Celsius and at a relative humidity of 15% RH.

Reference images for evaluation of toner scattering, residual image, and image with electric discharge were specified in advance, and the evaluation was conducted to rank the results based on the reference images. That is, toner scattering was evaluated by rank and residual image and image with electric discharge were evaluated based on whether the defective image was produced or not. Rank 5 represents a highest rank for toner scattering, indicating good image performance, and as the level of the rank descends, the image quality degrades or the image with toner scattering increases. Rank 4 is set to be a threshold or border of acceptance for toner scattering.

In the comprehensive evaluation, "Good" represents good level of image evaluated as a good image after the image formed on the 10th paper sheet is visually examined; "Acc'ble" represents acceptable level of image evaluated as an acceptable image even though the image has at least one of toner scattering, residual image, and image with electric discharge; and "Poor" represents poor level of image evaluated as a poor image when the image is defected to an unacceptably low level.

As can be seen from Table 1, it is difficult to determine whether unacceptable toner scattering, residual image, and image with electric discharge can be prevented or not according to the resistivities of material of each surface layer of the belt members in Examples 1 to 3 and Comparative Examples 1 to 6.

Generally the resistivity of a belt member is measured as a volume resistivity or a surface resistivity in a predetermined period of time (for example, for 10 seconds). However, since a multi-layer belt generally includes two or more layers having different resistivities and thicknesses, the above-described resistivity measurement of such a multi-layer belt is usually conducted for an overall multi-layer belt, but not for individual layers. Therefore, even if multi-layer belts have an identical resistivity to each other, the transfer quality of each belt can be different from other belt(s). Accordingly, variations of the transfer quality of the multi-layer belts are controlled by adjusting the main system of an image forming apparatus.

Figure 5:
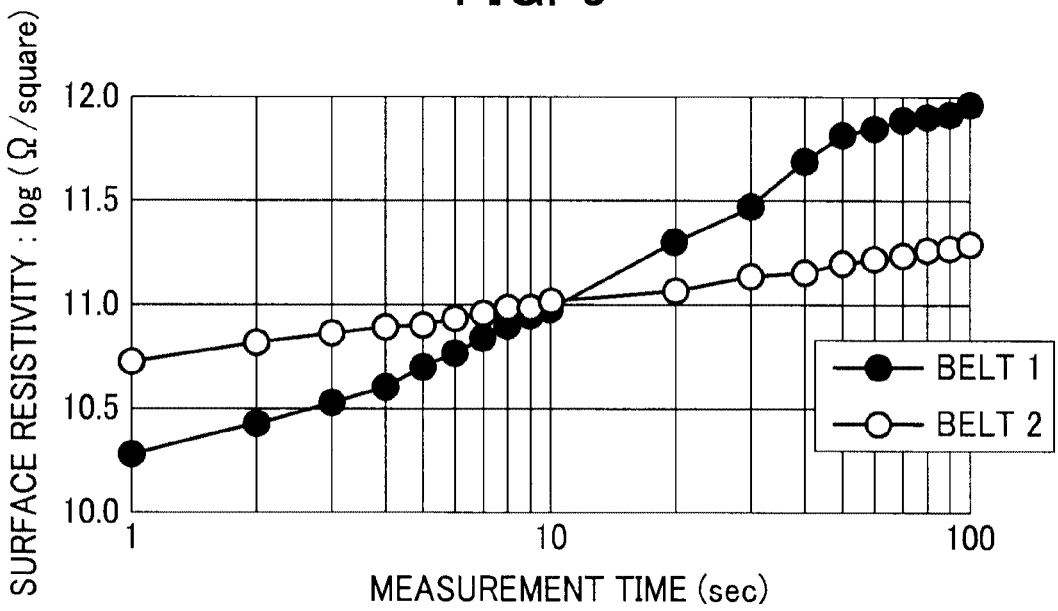
FIG. 5 is a graph showing differences between amounts of surface resistivity changes of two belts.

For example, when the surface resistivities of Belt 1 and Belt 2 both having a lamination structure including a surface layer with high resistivity are measured, respective values of surface resistivity measured after a given voltage is applied for 10 seconds are same while respective values of surface resistivity measured after a given voltage is applied for 100 seconds are significantly different, as shown in a graph of FIG. 5.

The reason why the surface resistivities measured after a given voltage is applied for 100 seconds are different is that electric charge retains on a boundary face formed between the surface layer with high resistivity and its adjacent layer when a given voltage is continuously applied to the belt member formed in a lamination structure having a surface layer with high resistivity, electric current cannot easily flow according to a time period for applying a voltage, and thus the surface resistivity of the belt member having the lamination structure increases. It is known that, as the surface resistivity increases, the electric charge retains on the boundary face more easily, which increases the amount of surface resistivity.

Thus, when the surface layer includes a material having high resistivity, even if the thickness of the surface layer is 1 μm, electric charge can be retained on the above-described boundary face and generate a problem such as residual image caused by residual electrical charge.

Since it is contemplated that a relation between the amount of resistivity change of surface of a belt member and the image evaluation can be observed, an amount of resistivity change of an outer inner surface (a surface on which an image is formed) of the belt member used in Examples 1 to 3 and Comparative Examples 1 to 6 and an amount of resistivity change of an inner surface (a surface opposite the surface on which an image is formed) of the belt member Examples 1 to 3 and Comparative Examples 1 to 6 were measured.

As shown in Table 1, after the measurement, the inventor concluded that the amounts of resistivity change of the inner surface "$\Delta\rho s_{b100}$" and "$\Delta\rho s_{b500}$" of the belt members used in Examples 1 to 3 and Comparative Examples 1 to 6 were 0.1 or smaller in a common logarithm value both when the voltage of 100V is applied and when the voltage of 500V is applied. Therefore, it is determined that the amount of resistivity change of the outer surface depends on the resistivity of the surface layer of the belt member.

Figure 6:
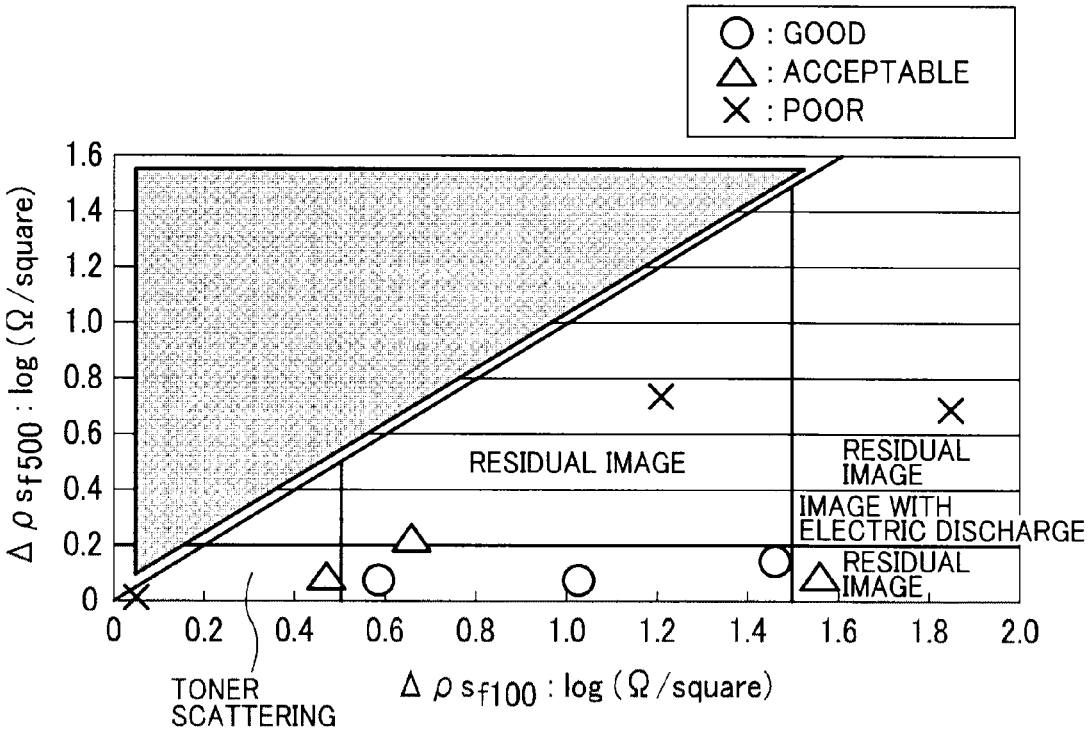
FIG. 6 is a graph showing changes of the surface resistivity of two different types of belts having outer and inner surfaces with high resistivity.

FIG. 6 is a graph showing relation or changes of the image evaluation and the surface resistivity of the outer surface of the belt members used in Example 1 to 3 and Comparative Examples 1 to 6 based on Table 1. Whereas a horizontal axis indicates "$\Delta\rho s_{f100}$", which is the amount of resistivity change of the outer surface when the voltage of 100V is applied, and a vertical axis indicates "$\Delta\rho s_{f500}$", which is the amount of resistivity change of the outer surface when the voltage of 500V is applied.

As can be seen from the results of Table 1 and FIG. 6, the belt members of Examples 1 to 3 did not cause any unacceptable problem such as toner scattering, residual image, and image with electric discharge, that is, the belt members of Examples 1 to 3 could form good images.

In the belt members of Examples 1 to 3, when a low voltage, for example, the voltage of 100V is applied continuously, an amount of electric charge that has a polarity opposite the toner charge polarity and is sufficient to retain the toner image formed on the outer surface of the belt member can be held on the boundary face formed between the surface layer and the intermediate layer. Therefore, problems such as toner scattering was be prevented.

Further, when a high voltage, for example, the voltage of 500V is applied is applied continuously, an amount of electric charge sufficient to prevent or reduce toner scattering and residual image on the boundary face formed between the surface layer and the intermediate layer. Therefore, these problems were be prevented.

Even though it is not shown in Table 1, a large voltage dependency of surface resistivity was not observed in the belt members of Examples 1 to 3.

By contrast, as can be seen from the results of Table 1 and FIG. 6, at least one of toner scattering, residual image, and image with electric discharge was observed in the comprehensive evaluation of the belt members of Comparative Examples 1 to 6.

The belt member of Comparative Example 2 obtained Rank 3.5 in toner scattering and was not classified into "Good" but was evaluated as "Acceptable".

When the tests were conducted on the belt members used in Comparative Examples 3 and 6, the residual image was observed but the results were classified into "Acceptable".

According to the above-described results, when the belt members of Comparative Examples 1, 4, and 5 were used, at least one of toner scattering, residual image, and image with electric discharge occurred at an unacceptable level so as to produce a defective image as a result.

Further, the belt member of Comparative Example 2 caused toner scattering on an image, however, resulted in "Acceptable" because the image was acceptable in actual use.

In addition, the belt members of Comparative Examples 3 and 6 caused residual image but obtained acceptable images.

According to the above-described results, the intermediate transfer belt 201 that is used for an image forming apparatus and serves as a desirable multi-layer endless belt member having an inner surface and an outer surface with a resistivity higher than the inner surface can be made as follows: a surface resistivity of the inner surface of the intermediate transfer belt 201 ranges from approximately 9.0 to approximately 12.5 in a common logarithm value (log [Ω/square]) when the resistivity of the inner surface is measured after the voltage of 500V is applied for 10 seconds; an amount of resistivity change in a resistivity of the outer surface of the intermediate transfer belt 201 ranges from approximately 0.5 to approximately 1.5 in a common logarithm value (log [Ω/square]) when the resistivity of the outer surface is measured after the voltage of 100 is applied and the amount of resistivity change of the resistivity of the outer surface of the intermediate transfer belt 201 is equal to or smaller than 0.2 in a common logarithm value (log [Ω/square]) when the voltage of 500V is applied, where the amount of resistivity change in the resistivity of the outer surface represents a difference between the resistivity thereof measured after a given voltage is applied for 1 second and the resistivity thereof measured after a given voltage is applied for 100 seconds to the outer surface of the intermediate transfer belt 201; and an amount of resistivity change in the resistivity of the inner surface of the intermediate transfer belt 201 is equal to or smaller than 0.1 in a common logarithm value (log [Ω/square]) when the resistivity of the inner surface is measured after the voltage of 100V is applied and the voltage of 500V is applied, where the amount of resistivity change in the resistivity of the inner surface represents a different between the resistivity of the inner surface measured after a given voltage is applied for 1 second and the resistivity of the inner surface measured after a given voltage is applied for 100 seconds to the inner surface of the intermediate transfer belt 201. According to the above-described configuration, the intermediate transfer belt 201 can prevent unacceptable toner scattering, residual image, and electric discharge, thereby obtaining images in good quality.

Further, at least the amount of resistivity change of the outer surface tends to increase as the applied voltage decreases. For example, if a belt member has outer and inner surfaces with high resistivity such as the belt member used in Examples 1 to 3 and Comparative Examples 1 to 6 and the amount of resistivity change of the outer surface of the belt member obtained when the voltage of 100V is applied, which is indicated as "$\Delta\rho s_{f100}$", is 1.0 in a common logarithm value (log [Ω/square]), the amount of resistivity change of the outer surface of the belt member obtained when the voltage of 500V is applied, which is indicated as "$\Delta\rho s_{f500}$", cannot be 1.0 or more in a common logarithm value (log [Ω square]). According to the above-described result, the belt member of Examples 1 to 3 and Comparative Examples 1 to 6 may not include a characteristic illustrated in a gray area of the graph of FIG. 6.

Further, the belt member used in the above-described tests was an elastic belt having three layers of a base layer, an intermediate layer, and a surface layer, but not limited thereto. A belt member having a different layer structure can be applied to an exemplary embodiment of the present invention. By satisfying the above-described conditions, unacceptable levels of toner scattering, residual image, and image with electric discharge can be prevented.

As described above, a multi-layer endless belt member (i.e., the intermediate transfer belt 201) for use in an image forming apparatus (i.e., the image forming apparatus 1) has an inner surface and an outer surface with a resistivity higher than the inner surface. A surface resistivity of the inner surface of the intermediate transfer belt 201 ranges from approximately 9.0 to approximately 12.5 in a common logarithm value (log [Ω/square]) when the resistivity of the inner surface is measured after the voltage of 500V is applied for 10 seconds. An amount of resistivity change in a resistivity of the outer surface of the intermediate transfer belt 201 ranges from approximately 0.5 to approximately 1.5 in a common logarithm value (log [Ω/square]) when the resistivity of the outer surface is measured after the voltage of 100V is applied and the amount of resistivity change of the resistivity of the outer surface of the intermediate transfer belt 201 is equal to or smaller than 0.2 in a common logarithm value (log [Ω/square]) when the voltage of 500V is applied, where the amount of resistivity change in the resistivity of the outer surface represents a difference between the resistivity thereof measured after a given voltage is applied for 1 second and the resistivity thereof measured after a given voltage is applied for 100 seconds to the outer surface of the intermediate transfer belt 201. An amount of resistivity change in the resistivity of the inner surface of the intermediate transfer belt 201 is equal to or smaller than 0.1 in a common logarithm value (log [Ω/square]) when the resistivity of the inner surface is measured after the voltage of 100V is applied and after the voltage of 500V is applied, where the amount of resistivity change in the resistivity of the inner surface represents a different between the resistivity of the inner surface measured after a given voltage is applied for 1 second and the resistivity of the inner surface measured after a given voltage is applied for 100 seconds to the inner surface of the intermediate transfer belt 201. As shown in the results obtained from the previously described tests, the intermediate transfer belt 201 can prevent unacceptable toner scattering, residual image, and electric discharge, thereby obtaining images in good quality.

Further, according to an exemplary embodiment of the present invention, as shown in the results obtained from the previously described tests, the surface layer that has the resistivity higher than the base layer includes carbon black. Therefore, even when a high transfer voltage is applied, toner scattering and/or residual image caused by residual electric charge can be prevented.

Further, according to an exemplary embodiment of the present invention, as shown in the results obtained from the previously described tests, the outer surface and the inner surface of the intermediate transfer belt 201 include the surface layer and the intermediate layer, each having at least one of a conductive member and an ion conductive member. With this configuration, even when a high transfer voltage is applied, toner scattering and/or residual image caused by residual electric charge can be prevented.

Further, according to an exemplary embodiment of the present invention, the transfer unit 200 includes multi-layer endless belt member (i.e., the intermediate transfer belt 201 that serves as an intermediate transfer member) onto which each toner image formed on the photoconductors 102 that serve as an image carrier is temporarily transferred. With this configuration, as shown in the results obtained from the previously described tests, the transfer unit 200 having the intermediate transfer belt 201 can prevent unacceptable toner scattering, residual image, and electric discharge, thereby obtaining images in good quality.

Further, according to an exemplary embodiment of the present invention, the image forming apparatus 1 includes the photoconductor 102 (i.e., the photoconductors 102Y, 102M, 102C, and 102K) that serves as an image carrier to carry a latent image on a surface thereof, the developing unit 104 (i.e., developing units 104Y, 104M, 104C, and 104K in FIG. 1) to develop the latent image formed on the surface of the photoconductor 102 into a visible toner image, and the transfer unit 200 including the intermediate transfer belt 201. With this configuration, as shown in the results obtained from the previously described tests, the image forming apparatus 1 having the transfer unit 200 can prevent unacceptable toner scattering, residual image, and electric discharge, thereby obtaining images in good quality.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A multi-layer endless belt member for use in an image forming apparatus, the multi-layer endless belt member comprising:

a base layer; and a surface layer for carrying a toner image thereon disposed on the base layer and having a resistivity higher than the base layer, wherein:

the multi-layer endless belt member has a first resistivity of a first surface serving as an outer surface of the multi-layer endless belt member and a second resistivity of a second surface serving as an inner surface of the multi-layer endless belt member opposite the first surface different from the first resistivity, and the second resistivity of the second surface of the multi-layer endless belt member ranges from approximately 9.0 to approximately 12.5 in a common logarithm value (log [Ω/square]) when the second resistivity of the second surface is measured after 500V is applied for 10 seconds, an amount of resistivity change in the first resistivity of the first surface of the multi-layer endless belt member ranges from approximately 0.5 to approximately 1.5 in a common logarithm value (log [Ω/square]) when the first resistivity of the first surface is measured after 100V is applied and the amount of resistivity change of the first resistivity of the first surface of the multi-layer endless belt member is equal to or smaller than 0.2 in a common logarithm value (log [Ω/square]) when the first resistivity of the first surface is measured after 500V is applied, where the amount of resistivity change in the first resistivity of the first surface represents a difference between the first resistivity of the first surface measured after a given voltage is applied for 1 second and the first resistivity of the first surface measured after a given voltage is applied for 100 seconds to the first surface of the multi-layer endless belt member, and an amount of resistivity change in the second resistivity of the second surface of the multi-layer endless belt member is equal to or smaller than 0.1 in a common logarithm value (log [Ω/square]) when the second resistivity of the second surface is measured after 100V is applied and 500V is applied, where the amount of resistivity change in the second resistivity of the second surface represents a difference between the second resistivity of the second surface measured after a given voltage is applied for 1 second and the second resistivity of the second surface measured after a given voltage is applied for 100 seconds to the second surface of the multi-layer endless belt member.

2. The multi-layer endless belt member according to claim 1, wherein the surface layer having the resistivity higher than the base layer includes carbon black.

3. The multi-layer endless belt member according to claim 2, wherein the first surface and the second surface include layers each having at least one of an electron conductive member and an ion conductive member.

4. A transfer unit including an intermediate transfer member onto which a toner image formed on an image carrier is temporarily transferred, the transfer unit comprising the multi-layer endless belt member according to claim 1.

5. An image forming apparatus, comprising:

an image carrier to carry a latent image on a surface thereof;

a developing unit to develop the latent image formed on the surface of the image carrier into a visible toner image; and the transfer unit according to claim 4.

* * * * *